United States Patent [19]

Wyatt

[11] Patent Number: 4,708,344

[45] Date of Patent: Nov. 24, 1987

[54] BASEBALL GAME APPARATUS

[76] Inventor: Hugh J. Wyatt, 5111 - 58B Street, Delta, British Columbia, Canada, V4K 3J6

[21] Appl. No.: 15,213

[22] Filed: Feb. 17, 1987

[51] Int. Cl.[4] ..... A63F 3/00

[52] U.S. Cl. ..... 273/93 R

[58] Field of Search ..... 273/93 R, 93 C, 244, 273/277, 298

[56] References Cited

U.S. PATENT DOCUMENTS

| | | | |
|---|---|---|---|
| 613,658 | 11/1898 | Bourke | 273/93 R |
| 643,808 | 2/1900 | Brewer et al. | 273/93 R |
| 1,009,471 | 11/1911 | Campbell | 273/93 R |
| 1,153,899 | 9/1915 | Elcouin | 273/93 C X |
| 1,320,315 | 10/1919 | Clarke | 273/93 R |
| 1,458,275 | 6/1923 | Cossitt | 273/93 R |
| 1,492,368 | 4/1924 | Fonai | 273/93 R |
| 1,530,676 | 3/1925 | Keely | 273/93 R |
| 1,544,308 | 6/1925 | Gelpi | 273/93 R |
| 1,550,692 | 8/1925 | Gorman | 273/93 R |
| 1,550,692 | 8/1925 | Gorman | 273/93 R |
| 1,552,617 | 9/1925 | Kisor | 273/93 R |
| 1,625,200 | 4/1927 | Franke et al. | 273/93 R |
| 1,684,189 | 9/1928 | Meyer | 273/93 C |
| 2,134,461 | 10/1938 | Fusco | 273/93 R X |
| 2,388,577 | 11/1945 | Shenker | 273/93 R |
| 2,788,213 | 4/1957 | Hull | 273/93 C |
| 4,244,571 | 1/1981 | Haglof | 273/93 R |
| 4,378,115 | 3/1983 | Terrero | 273/93 C |
| 4,452,453 | 6/1984 | Daley et al. | 273/93 R |

*Primary Examiner*—Paul E. Shapiro

*Attorney, Agent, or Firm*—Arnold, White & Durkee

[57] ABSTRACT

A board game to simulate the game of baseball is provided in which each of the fielding players is represented by an individual die. The pitcher throws a die to randomly select a particular type of pitch from a repertoire of pitches, and the batter selects a die corresponding with such pitch to randomly select the outcome of the pitch.

3 Claims, 2 Drawing Figures

BASEBALL GAME APPARATUS

BACKGROUND OF THE INVENTION

The invention relates to a game apparatus for simulating the game of baseball using dice and a game board.

Numerous game apparatus have been devised in the past to provide parlour games which attempt to reproduce the different combinations of plays and strategies which occur in the actual game of baseball. Such apparatus use various means for randomly selecting the sequence of events for the game. For example, U.S. Pat. No. 1,320,315 issued Oct. 28, 1919 to Clarke discloses a game of parlour baseball which utilizes three sets of three dice each to determine the sequence of events in the game. Each set of three dice represents a pitcher of a given ability, with the result of the throw of a set of dice being the outcome of a given pitch.

U.S. Pat. No. 1,530,676 issued Mar. 24, 1925 to Keeley similarly discloses a simple game apparatus in which four dice are used to simulate the events in a baseball game. Separate dice indicate plays which may be made by the base runner, batter, pitcher and fielder. Similarly, U.S. Pat. No. 1,550,692 issued Aug. 25, 1925 to Gorman similarly discloses a game apparatus in which the sequence of events in a baseball game is simulated using dice. Here, eleven different dice are used to determined the result of a pitch as well as base running. Numerous other games have used various random selecting means to simulate a live baseball game, but such games have lacked the element of strategic choice and the full range of possible outcomes which makes the game more interesting and enjoyable and a closer simulation of the intricacies of the real game.

The present invention provides a baseball-simulating game in which each of the fielding players is represented by a random-event selecting element. Further, the present invention provides a baseball game simulating apparatus in which the pitcher randomly selects a particular type of pitch from a repertoire of pitches, much as would be the case in a real baseball game, with the possible outcomes resulting from such selection being different. In this way a baseball game apparatus is provided which more closely simulates the actual possible outcomes in a baseball game.

BRIEF DESCRIPTION OF THE DRAWINGS

In the drawings which illustrate an embodiment of the invention.

DETAILED DESCRIPTION OF AN EMBODIMENT OF THE INVENTION

Figures 1, 2:
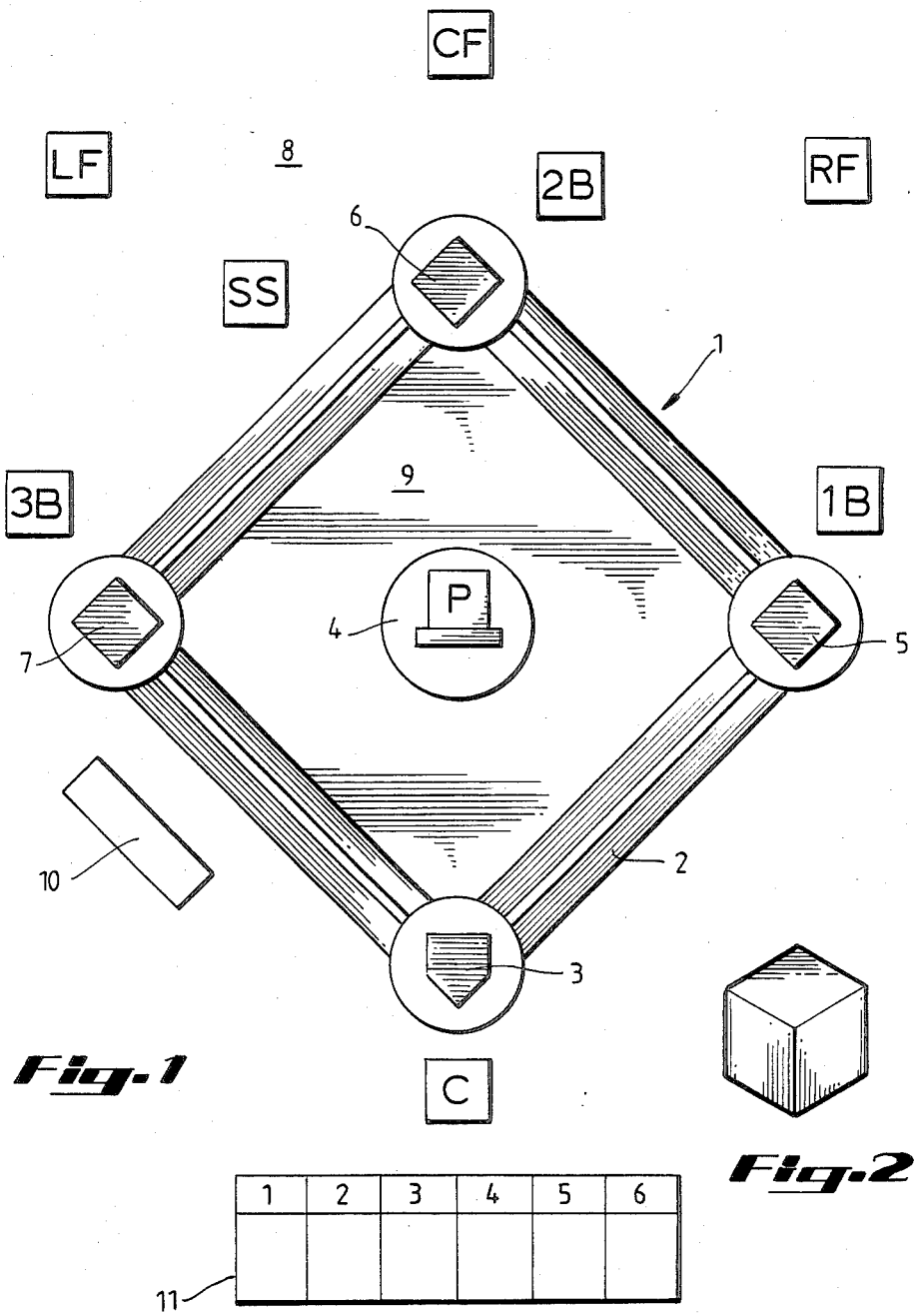
FIG. 1 is a plan view of a game board for playing the game of the invention; and, FIG. 2 represents a sample die as used in the game of the invention.

Referring to FIG. 1, the game board used to play the game of the invention is shown, having a representation of a baseball diamond 1 with foot paths 2, home plate 3, pitcher's mound 4, first, second and third bases 5, 6 and 7 respectively, an outfield 8 and an infield 9. The positions for the none fielded players are indicated, namely the pitcher (P), catcher (C), first base (1B), second base (b 2B), third base (3B), short stop (SS), left field (LF), center field (CF) and right field (RF). The positions for the fielded players are designed to have a die placed thereon, and accordingly the squares shown for the positions of the fielded players may be slightly recessed in the surface of the game board to facilitate the placement of a die.

The batting team is represented by nine playing pieces, which are aligned in the simulated dugout 10. Either a single collection of pieces can be used for whichever team is batting at the time, or alternatively a second dugout with a collection of 9 playing pieces may be symmetrically located adjacent first base for a second team.

Six dice are used by the member of the batting team who is up to bat and these are arranged in six numbered boxes indicated at 11. A single die is also assigned to each of the locations of a player in the field. Each of the players to which each of the dice in the field relates is marked on each of the dice, such as by noting the initials representing the field position, as shown in FIG. 1, on each face of the die. For example, the pitcher's die might have the letter "P" marked on each face.

The pitcher's die has marked on each face a unique numeral from one through six. Also marked on each face is the name of a pitch. The face with numeral "1" is marked with "FASTBALL". Face "2" is marked "SLIDER". Face "3" is marked "CURVE BALL". Face "4" is marked "SINKER". Face "5" is marked "KNUCKLE BALL" and face "6" is marked "CHANGE-UP". The numerals on each face relate to the number of the 6 batter's dice.

Each of the six batter's dice is marked with a unique one of the numerals one through six, such as by marking the numeral on each face of the die. Also marked on each face of a batter's die is the outcome of a pitch, whether ball, strike, fly ball, etc. The frequency in which any outcome occurs has been selected to closely simulate the actual scores in baseball games. The actual markings on the batter's die in the preferred form of the game are shown in the following table.

| 1 | 2 | 3 |
|---|---|---|
| BALL | STRIKE | BALL |
| STRIKE | STRIKE | BALL |
| STRIKE | FLY L.F. | FLY R.F. |
| HOME RUN | GROUND 3B | GROUND C.F. |
| GROUND S.S. | BUNT FOUL | STRIKE |
| BUNT FAIR | BALL | STRIKE |
| **4** | **5** | **6** |
| BALL | BALL | FOUL BALL |
| BALL | BALL | DOUBLE |
| SINGLE | FOUL BALL | GROUND L.F. |
| GROUND 2B | GROUND R.F. | FLY C.F. |
| STRIKE | GROUND 1B | STRIKE |
| STRIKE | STRIKE | BALL |

A catcher's die has marked on each face the result of a play at home plate. In the preferred form, five of the faces are marked "OUT" while one is marked "SAFE".

The dice for the first, second and third basemen similarly have marked on each face the result of a play made at that base. In the case of the first baseman, in the preferred form four of the faces are marked "OUT" and two of the faces are marked "SAFE". In the case of the second baseman, three of the faces are marked "SAFE" while three are marked "OUT". In the case of the third baseman, one face is marked "SAFE" and five are marked "OUT" in the preferred form of the game.

The dice for the remaining four players in the field carry a marking indicating the result of a ball hit to that particular fielder. In the case of all four fielders, namely the left fielder, right fielder, center fielder and short stop, five faces of the fielder's die bear the words "A CATCH" while the sixth face bears the word "ERROR", in the preferred form of the game.

To play the game, the member of the team in the field representing the pitcher rolls the pitcher's die, resulting in an indication of the type of pitch. The member of the batting team who is at bat then selects the number of the batters die corresponding to the number of the pitch thrown. For example, if the result of the throw of the pitcher's die was a curve ball, which is indicated by numeral three, the batter selects die number three from the six batter's die and rolls it. The result of the roll of the batter's die is the result of the pitch.

Following the result of the pitch, the usual rules of baseball apply. For example, once four balls have been thrown, the batter walks to first base. Once three strikes are thrown the batter is out and so on.

A "BUNT:FAIR" is a fair ball and the fielding team may attempt to put the batter out by selecting the die of either the first, second or third baseman and rolling it to determine the outcome of the bunt. The attempted out may be indicated as an attempt at a double or triple play where appropriate.

A ground ball to left, right or centre field allows the runner a safe hit to first base and any other runner on base may advance one base safely. If a runner wishes to attempt to take an additional base he does so with the risk of being thrown out at that base.

A single is a safe hit. Any other runner on base may advance safely one base. The runner may take additional bases at the risk of being thrown out at that base. A double is a safe hit to second base. Any other runners on base may advance two bases safely, including to home base. Again additional bases may be taken only at the risk of being thrown out at that base.

If a ground ball to first, second or third base is hit, an attempt may be made to throw the runner out at a base selected by the fielding player. A double or triple play may be attempted in the appropriate situation.

When the result of the throw of the batter's die is indicated as a fly ball or grounder to right, center, left field or short stop, the designated fielder throws his die to indicate the ball being caught or an error committed. If a fly ball is caught the batter is out. If a ground ball to the short stop is caught, a play may be made on any base, as above. If an error is committed the batter may proceed to first base, in the case of an error by the short stop, or second base, in the case of an error by an outfielder, safely and may advance additional bases only at the risk of being thrown out by the next baseman. If a runner is on base when a runner hits a fly ball, the batter must declare his intention whether to advance a base prior to the designated fielder throwing his die. If the runner has advanced and the designated fielder catches the ball, the runner must attempt to return to his previous base and that baseman will throw his die in an attempt to put the runner out. If the fielder commits an error, the runner may remain on base, and may attempt to take additional bases again at the risk of being thrown out.

To stimulate base stealing, if the pitcher's throw results in a ball or called strike, the runner on base may attempt to advance a base at the risk of being thrown out. If the fielding team fails to notice that the runner has advanced a base and proceeds to make the next pitch, the runner is deemed safe. Normally, the fielding team will notice the runner advancing and the appropriate baseman will throw his die to determine the result of the play. The game proceeds in this way according to the usual rules of baseball until, after three outs, the players exchange places. As according to the usual rules of baseball, the game is over after nine innings, extra innings may be played where the game ends in a tie according to the usual rules.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims. For example, the frequency with which the various outcomes appear on the various dice may be altered in order to vary the number of runs which ultimately are scored as desired.

I claim:

1. A game apparatus for simulating the game of baseball comprising:

(a) a game board having a representation of a baseball diamond depicted thereon;

(b) a plurality of individual pieces adapted for movement about the board to represent the position of runners on the base pads;

(c) an element for randomly selecting the pitch thrown by the pitcher;

(d) elements for each of the four basemen in the field for randomly selecting the outcome of a play at that base;

(e) an element associated with each of the possible pitches thrown by the pitcher for randomly selecting the outcome of said pitch; and, (f) elements associated with each of the four fielding players for randomly selecting the outcome of a hit directed to that fielder.

2. The game apparatus of claim 1 wherein said random selection elements comprise six-sided dice.

3. The game apparatus of claim 2 comprising six dice corresponding to the six possible pitches for randomly selecting the outcome of said six possible pitches.

* * * * *